US007472959B1

(12) United States Patent
Ratza et al.

(10) Patent No.: US 7,472,959 B1
(45) Date of Patent: Jan. 6, 2009

(54) FOLDING SEAT

(75) Inventors: Clifton J. Ratza, Richfield, WI (US); Trent Eekhoff, Grand Rapids, MI (US); Ryan Millhouse, Byron Center, MI (US)

(73) Assignee: Milsco Manufacturing Company, A Unit of Jason Incorporated, Milwaukee, WI (US)

( * ) Notice: Subject to any disclaimer, the term of this patent is extended or adjusted under 35 U.S.C. 154(b) by 77 days.

(21) Appl. No.: 11/127,620

(22) Filed: May 12, 2005

Related U.S. Application Data

(60) Provisional application No. 60/570,734, filed on May 12, 2004.

(51) Int. Cl.
*A47C 7/42* (2006.01)

(52) U.S. Cl. ..... 297/378.1; 297/440.15; 297/440.21

(58) Field of Classification Search ..... 297/378.1, 297/378.12, 440.15, 440.21, 378.14
See application file for complete search history.

(56) References Cited

U.S. PATENT DOCUMENTS

| | | | |
|---|---|---|---|
| 230,491 | A | 7/1880 | Peer |
| 277,326 | A | 5/1883 | Munger |
| 403,772 | A | 5/1889 | Old |
| 814,288 | A | 3/1906 | Hausfeld et al. |
| 875,251 | A | 12/1907 | Field |
| 1,050,518 | A | 1/1913 | Cogger |
| 1,116,714 | A | 11/1914 | Lang |
| 1,397,675 | A | 11/1921 | Buske |
| 1,467,582 | A | 9/1923 | Lang |
| 1,515,564 | A | 11/1924 | Field |
| 1,555,781 | A | 9/1925 | Amsden |
| 1,729,687 | A | 10/1929 | Savage |
| 2,070,387 | A | 2/1937 | Vandervoort |
| 2,312,638 | A | 3/1943 | Gedris |
| 2,500,135 | A | 3/1950 | Nordmark |
| 2,536,157 | A | 1/1951 | Campanelli |
| 2,677,147 | A | 5/1954 | Phillips |
| 3,065,498 | A | 11/1962 | Johnson |
| 3,245,717 | A | 4/1966 | Levy |
| 3,287,060 | A | 11/1966 | Thompson |
| 3,388,421 | A | 6/1968 | Koziol |
| 3,432,882 | A | 3/1969 | Farouche |
| 3,690,726 | A | 9/1972 | Van Ryn |
| D227,833 | S | 7/1973 | Olson |
| 3,936,907 | A | 2/1976 | Jansons |

(Continued)

*Primary Examiner*—Peter R. Brown
(74) *Attorney, Agent, or Firm*—Boyle Fredrickson, S.C.

(57) ABSTRACT

A modular folding seat for use in vehicles is provided. The seat includes a base securable to the vehicle; a backrest pivotally connected to the base, and can include a removable backrest panel mounted to the backrest. The base or the backrest includes a pair of outwardly extending bosses disposed on opposite sides that are rotatably engageable within recesses disposed in the other one of the base or backrest. The bosses are held within the recesses by a pair of engagement members disposed adjacent or in each recess. The engagement members are capable of being deflected to a non-securing position whereby the bosses can be inserted into or withdrawn from the recesses to assemble or disengage the backrest to or from the base. A plurality of regions of engagement between the base and backrest keep the backrest from over rotating beyond a fully upright position and resist downward folding of the backrest when in the upright position. Another engagement region can be provided to park the backrest in a downwardly folded position.

28 Claims, 6 Drawing Sheets

U.S. PATENT DOCUMENTS 3,989,298 A * 11/1976 Cycowicz et al. ..... 297/342
4,058,890 A 11/1977 Pierce et al.
4,079,992 A 3/1978 Thrift et al.
4,133,579 A 1/1979 Springfield
4,334,338 A 6/1982 Conn
4,372,609 A 2/1983 Boisset
4,383,488 A 5/1983 Macho et al.
4,477,199 A 10/1984 Manzoni
4,521,052 A 6/1985 Cone
4,729,134 A 3/1988 Hillebrand et al.
4,746,166 A 5/1988 Sadan
4,775,187 A 10/1988 Herr
4,871,209 A 10/1989 Handelman
4,881,776 A * 11/1989 Wang ..... 297/378.1
4,902,070 A 2/1990 Casale et al.
4,953,259 A 9/1990 Frye et al.
D312,004 S 11/1990 Smith et al.
4,989,915 A 2/1991 Hansal
5,042,875 A 8/1991 Biggs, Sr.
5,052,076 A 10/1991 Spaeth
5,094,505 A 3/1992 Nichols
D330,639 S 11/1992 Munro et al.
5,172,969 A 12/1992 Reuter et al.
D333,737 S 3/1993 Adams
5,190,344 A 3/1993 Anderson et al.
5,269,589 A * 12/1993 Brothers et al. ..... 297/440.16
5,334,354 A 8/1994 Johnston et al.
D355,779 S 2/1995 Tribelsky
5,463,972 A 11/1995 Gezari et al.
5,501,501 A 3/1996 White et al.
5,518,296 A 5/1996 Compardo
5,524,915 A 6/1996 Liu
5,547,257 A 8/1996 Lavender
5,658,047 A 8/1997 Ratza et al.
5,690,384 A 11/1997 Rossi
5,725,279 A 3/1998 Ward et al.
5,820,220 A 10/1998 Wu
D407,570 S 4/1999 Frauenberger
D411,381 S 6/1999 Greaves et al.
5,956,810 A 9/1999 Spaeth
5,992,936 A 11/1999 Greaves
6,015,190 A 1/2000 Wend
D420,816 S 2/2000 Wilcox et al.
6,045,190 A 4/2000 Ward et al.
6,089,669 A 7/2000 Wilcox et al.
6,116,183 A 9/2000 Crow et al.
6,164,724 A 12/2000 Greaves
6,252,727 B1 6/2001 Vogt
D449,458 S 10/2001 Malmanger et al.
6,302,367 B1 10/2001 Ratza et al.
6,334,652 B1 * 1/2002 Chen et al. ..... 297/357
6,353,970 B1 3/2002 Spaeth
6,357,830 B1 3/2002 Ratza et al.
6,438,798 B1 8/2002 Chene et al.
6,464,300 B2 10/2002 Grove
D465,360 S 11/2002 Ratza et al.
6,474,738 B1 11/2002 Ratza et al.
6,513,873 B2 2/2003 Tsuda et al.
6,513,876 B1 2/2003 Agler et al.
6,523,900 B1 2/2003 Conner et al.
D473,390 S 4/2003 Hannon et al.
6,546,595 B2 4/2003 Huse
D479,051 S 9/2003 Darst et al.
6,644,751 B2 11/2003 Ratza et al.
6,648,419 B2 11/2003 Ratza et al.
6,752,461 B2 6/2004 Hamelin
6,786,553 B1 9/2004 Grove
D504,243 S 4/2005 Begin et al.

* cited by examiner

FOLDING SEAT

CROSS-REFERENCE TO RELATED APPLICATION

This application claims the benefit of and priority under 35 U.S.C. Section 119(e) to U.S. Provisional Application Ser. No. 60/570,734, filed May 12, 2004, the entirety of which is hereby expressly incorporated herein by reference.

FIELD OF THE INVENTION

The present invention relates to seats or chairs, and more specifically to foldable seats or chairs designed for use with recreational vehicles, such as boats, watercraft, and the like.

BACKGROUND OF THE INVENTION

In recreational vehicles, such as boats and other watercraft, chairs or seats are often utilized in order to enable individuals to sit comfortably in or on the vehicle while the vehicle is in operation. To enhance the ability of the seat to provide a comfortable and stable seating surface for an individual onboard the vehicle, numerous vehicle seats have also been supplied with foam pads which are contacted by an individual resting on the seat to both provide a soft surface on which the individual may rest and, to a certain extent, maintain the individual in place on the seat.

While many vehicle seats have been previously designed with integral backrests in order to provide a seat and backrest for an individual, the seats having integral non-folding backrests presented certain problems. More specifically, the integral non-folding backrest interfered with the ability of individuals to move about the vehicle when performing certain activities on the vehicle, such as fishing, as well as complicating the storage of the vehicle due to the height of the backrests. In addition the non-folding backrest of the seat, depending on the seat location in a boat, often impaired the visibility of the boat operator while driving.

To overcome this deficiency, more recently seats have been developed in which the backrest is pivotally secured to a base of the seat such that when the seat is not occupied, the backrest can be folded downwardly over the seat base into a more compact configuration that helps to prevent the seat from obstructing the movement of people on the vehicle, makes it easier to store the vehicle as well as improve driving visibility. Additionally, folding backrests aid in shielding the seat portion from exposure to rain and allow for the easy installation and removal of storage covers.

Recreational vehicle seats have been developed with folding backrests that use a pair of formed metal hinges to attach the backrest to the seat in a manner that permits the backrest to pivot relative to the seat portion. Each hinge consists of a first leaf equipped with spaced apart hinge knuckles, a second leaf equipped with spaced apart hinge knuckles, and a pin that extends through the knuckles of both leaves creating a pivoting joint therealong. One side of the seat is fastened to one of the leaves of each hinge and a corresponding side of the backrest is fastened to the other one of the leaves of each hinge, typically with threaded fasteners. While simple in construction, this design is costly because it is generally time consuming to make and assemble. In addition, the metal hinges are typically exposed, which presents a significant pinch point that could injure a person when the seat is rotated in either direction.

An example of a second type of seat equipped with a folding backrest is disclosed in U.S. Pat. No. 5,992,936. This folding backrest design consists of a molded seat base and backrest that are pivotally joined at a pivot point by a hinge pin. An upholstered removable seat base panel is attached to the seat base with threaded fasteners. Likewise, the backrest is formed by securing an upholstered removable seat back panel to the seat back with threaded fasteners. While this design has reduced the likelihood of injury occurring while rotating the backrest, it has not significantly improved upon the time required to assemble the components, as a total of eight threaded fasteners are needed to attach the upholstered seat backrest and seat base cushions. Moreover, as with its predecessor, the hinges are also located outboard of the seat and backrest thereby exposing each hinge and resulting in a less aesthetically appealing seat.

A third type of folding backrest seat design uses spaced apart hinge knuckles that are integrally formed in a seat base and backrest molding. In assembly, the knuckles of the seat base are positioned such that each knuckle is received between a pair of the knuckles of the backrest. The knuckles each have one or more transversely extending openings that accept a pivot rod that is received therein, thereby enabling the backrest to pivot relative to the seat base. An example of this type of folding backrest seat design is disclosed in U.S. Pat. No. 6,644,751.

However, in order to prevent the rod from inadvertently disengaging from the knuckles, the base and backrest are formed such that the rod is completely enclosed within the assembled seat. This construction greatly increases the difficulty of assembling the seat because the components cannot simply be assembled in a manner that easily allows for the rod to be subsequently inserted. Further, after the seat is assembled, and the foam cushion or cushions are attached to various parts of the seat, should any portion of the seat become damaged during use, it is not possible to simply remove that portion of the seat or otherwise disassemble the seat without also damaging the cushions and other portions of the seat. Therefore, with seats of this type, once the seat becomes damaged, it is required that the entire seat must be replaced rather than only the damaged part.

As a result, it is desirable to develop a folding seat having a modular construction such that, when the seat is damaged, the damaged part of the seat can be disassembled, removed and replaced without having to also remove and/or replace the undamaged parts of the seat. Further, the seat components should also be able to be easily assembled as a result of the construction of the connections between the respective parts of the seat, including the hinge mechanism, to speed up the manufacturing process for the seat.

SUMMARY OF THE INVENTION

The present invention is directed to a seat or chair for a vehicle that preferably is used in off-road applications. An example of preferred vehicles for which a seat made in accordance with the invention is well suited is a boat, yacht, ship or other watercraft.

The seat has a base and a backrest that extends upwardly from the base. The seat can be equipped with a removable backrest panel that mounts to the free end of the backrest. The seat is foldable about a hinge or pivot arrangement that preferably is formed where the backrest engages the base. The hinge or pivot arrangement preferably is of integral construction and is interiorly disposed or recessed within the seat. In a preferred embodiment, the hinge or pivot arrangement is recessed so as to be substantially completely enclosed by the seat.

The seat base and backrest preferably both include a shell formed of plastic such as by molding. The base has a seat occupant supporting portion that underlies the buttocks and which can also underlie a portion of each thigh of a seat occupant sitting in the seat. Where added comfort is desired, there is at least one resilient cushion attached to or otherwise formed as part of the base and backrest. If desired, the base and backrest can include one or more bolsters that can be of integral construction and that can include one or more resilient cushions.

Either the base or the backrest preferably includes a mount that facilitates pivoting attachment of the backrest to the base. The base or the backrest have a pair of arms that are spaced apart so as to receive the mount of the other one of the base and the backrest such that the mount is located between the arms. A pivot joint is formed by engagement between each arm and the mount. Each pivot joint preferably snaps together so as to be of snap fit construction, if desired. Each pivot joint includes a boss of one of the base or backrest that is received in a boss receiver of the other one of the base or backrest. Each pivot joint preferably is disposed within the seat such that it is not externally visible.

In a preferred embodiment, the pair of spaced apart arms form a pivot hinge socket and the mount forms a pivot hinge head that snaps into the pivot hinge socket in a manner that permits the backrest to move relative to the base in a manner that allows the backrest to be folded when desired. Preferably, there are a plurality of opposed but generally coaxial bosses that provide an axis about which the backrest folds with each boss being pivotally or rotatively received in a corresponding boss receiver.

Each arm has an inboard sidewall that is disposed adjacent an outboard sidewall of the mount. In a preferred embodiment, the boss of each pivot joint is integrally formed of one of the inboard and outboard sidewall such that it extends outwardly therefrom. The boss receiver of each pivot joint preferably is a pocket that is integrally formed in the other one of the inboard and outboard sidewalls. When assembled, the inboard and outboard sidewalls overlie one another, covering each boss and each boss receiver of each pivot joint.

There preferably is a retainer disposed adjacent each pocket that facilitates assembly and disassembly of the head and base. In a preferred embodiment, the retainer permits manual insertion and can allow removal of one of the bosses from its corresponding boss receiver while opposing withdrawal and opposing non-pivoting movement of the boss during pivoting of the backrest.

In a preferred embodiment, the retainer includes a finger disposed adjacent to or in a mouth of the boss-receiving pocket with the finger being flexible so as to selectively enable the boss to be inserted into the pocket but opposing its withdrawal from the pocket. For example, when a boss is seated in its corresponding pocket and the finger is in an un-flexed condition, the finger interferes with removal of the boss from the pocket while permitting the boss to rotate in the pocket. When it is desired to remove the boss from its corresponding pocket, the retainer finger is manually urged or flexed until the boss can be withdrawn from its pocket without too much interference or no interference by the finger.

In a preferred embodiment, the retainer is a bracket having a mounting plate that is fixed to a pocket defining wall. The finger extends outwardly from the mounting plate. The finger preferably has a curled or rounded free end.

The base or the backrest has an end wall that overlies at least a portion of an end wall of the support of the other one of the base or backrest. When the backrest is disposed in a fully upright position, there is a detent arrangement formed by a first region of engagement between the end walls that releasably opposes forward rotation of the backrest toward the seat occupant support portion of the base. The detent arrangement is formed by a pawl in one of the end walls that is releasably received in a detent notch in the other one of the end walls. In one preferred embodiment, the pawl is a lip, rib or flange that extends outwardly from an end wall.

When the backrest is disposed in an upright position, preferably a fully upright position, there is a backrest rotation limiter formed by a second region of engagement between the end walls that prevents rotation of the backrest rearwardly beyond a certain stop position. The backrest rotation limiter is formed at least in part or in whole by a portion of one of the end walls wedging or camming against a portion of the other one of the end walls when the backrest is disposed in its upright stop position. This contact between the end walls serves to, in effect, define a stop beyond which rearward rotation of the backrest beyond the fully upright position is not possible.

Each end wall preferably is curved or otherwise three dimensionally contoured such that a rear or aft portion of each end wall bears against each other when the backrest is in its upright stop position, preferably its fully upright position, thereby preventing backrest over rotation. When the backrest is pivoted or rotated forwardly away from its upright stop position, an axis of rotation that extends through both pivot joints is eccentric relative to the engageable curved end wall portions thereby enabling them to separate or disengage as the backrest is moved away from its upright stop position. Clearance between these portions of the end walls is maintained as the backrest is folded farther forwardly.

The detent arrangement and backrest rotation limiter are spaced from each other in a fore-aft direction and form a force couple about the axis of backrest rotation that extends through the pivot joints to reduce the amount of fore-aft directed force that is transferred to each pivot joint. This advantageously reduces wear and tear on each pivot joint.

When the backrest is folded forwardly sufficiently far, it becomes disposed in a parked position that resists inadvertent pivoting back toward the fully upright position. This helps keep the seat in a folded position even when the seat or vehicle in which the seat is disposed is moved or transported. The backrest is releasably parked in its folded down position by a third region of engagement between the end walls that is spaced apart from the other aforementioned regions of engagement.

With regard to this third region of engagement, each end wall preferably has at least one rib that contacts the rib of the other end wall when the backrest is disposed in its parked position thereby opposing backrest movement away from the parked position. In a preferred embodiment, each end wall has a plurality of such engageable ribs that interfere with each other to oppose backrest movement away from the parked position. One or more such ribs of one or both end walls can become engaged, including with each other or some part of an end wall, at more than one region of engagement, if desired.

Where the seat is equipped with a removable backrest panel, the backrest preferably has a head that accepts a crown or hood of a saddle of the backrest panel. The saddle preferably includes a front anchor panel that attaches to a complementary mounting surface of the backrest. The anchor panel preferably includes a resilient cushion that is received on the saddle. The cushion can be fixed to the saddle such as by using fasteners, an adhesive or the like.

The crown or hood of the saddle has a plurality of pairs of walls that define a pocket having a shape complementary to that of the head of the backrest. In a preferred embodiment, a front wall, rear wall, and sidewalls of the head converge to form a head that tapers toward its free end and the crown or hood of the saddle has a front wall, rear wall, and sidewalls of like construction. As a result, the saddle is mounted to the head in a manner that prevents side-to-side and front-to-back movement of the backrest panel.

The saddle preferably includes a plurality of spaced apart arms or buttresses that are curved so as to hook or rest upon one of a pair of shoulders of the backrest that are spaced apart by the head. In a preferred embodiment, each buttress extends from the anchor panel to the crown or hood defining a frontwardly facing aperture or window therebetween.

In one preferred embodiment, the backrest mount is a support portion that extends upwardly from the seat occupant supporting portion of the base. The mount has a pair of sidewalls that each has a boss that extends outwardly therefrom. The backrest has a pair of integrally formed and spaced apart arms that each have a sidewall that is disposed adjacent a corresponding one of the mount sidewalls when the mount is disposed between the backrest arms. The sidewall of each arm has a pocket formed therein that is constructed and arranged to receive one of the bosses therein. The retainer preferably is a bracket having a mounting plate disposed in the pocket and a finger disposed in line with a mouth of the pocket.

The mount and backrest have end walls that are curved and that overlie one another when the backrest is disposed in the fully upright position. The rear or aft portion of each end wall bears against one another to oppose rearward backrest rotation beyond the fully upright position.

The detent arrangement is located forwardly from the rear or aft portion of each end wall. The pawl of the detent is a rib, flange or lip that extends downwardly from the backrest bottom wall. The detent notch is a recess that is integrally formed in the backrest mount end wall.

Each end wall has a plurality of transversely spaced apart ribs that are positioned so as to engage or interfere with each other when the backrest is disposed in a downwardly folded parked position.

In assembly, the seat component with the bosses is maneuvered until each boss is located adjacent the mouth of a respective one of the boss-receiving pockets. Force is applied to urge each boss against the respective finger disposed in line with the mouth of the corresponding pocket. Application of additional force causes each finger to deflect toward the pocket until each boss snaps into its respective pocket.

Thereafter, the backrest can be manually rotated between a fully upright position and a position disposed away from the fully upright position. When the backrest is disposed in the fully upright position, force applied in a forward direction causes the pawl of the detent arrangement to cam along a front inclined edge that defines part of the detent notch until the pawl is free of the notch. Thereafter, the backrest is folded forwardly toward the seat occupant portion of the base.

Where the seat is provided with an arrangement where it can be parked in a downwardly folded position, the plurality of ribs of each end wall bear against each other to oppose backrest rotation toward the fully upright position. Application of enough force will cause the ribs of one end wall to cam over the ribs of the other end wall until they disengage. Thereafter, the backrest can be freely rotated upwardly toward its fully upright position.

As the backrest nears the fully upright position, the pawl cams over the front inclined edge that defines part of the detent notch until it clears it and drops into the notch. As the backrest reaches the fully upright position, the rear or aft portion of each end wall bears against one another opposing further rearward backrest movement.

To remove the backrest from the base, the finger is manually deflected inward to permit the boss to at least partially clear the end of the finger. A force is applied to urge each boss toward the mouth of the pocket in which it is received, past the deflected finger until the free end of the boss clears the finger. Thereafter, the backrest can be lifted free of the base.

During operation, the pawl cams into the detent notch as the backrest is rotated to the upright stop position, preferably its fully upright position. Continued rotation or rearward backrest movement causes the backside or rear surface of the pawl to contact or bear against a rear wall of the detent notch creating interference therebetween. Continued application of force tending to urge the backrest rearwardly causes each boss to displace, preferably by sliding, along its corresponding boss-receiving pocket until it stops against the retaining element. Any further rearward backrest rotation causes part of the end wall of one of the backrest or base to wedge or otherwise cam against the end wall of the other one of the backrest and base.

A resultant moment is created due to at least a plurality of these regions of contact that resists any further rearward backrest movement, preventing over rotation. In a preferred embodiment, the resultant moment created by pawl and notch wall contact, by end wall to end wall contact, and boss and retaining element contact helps prevent further backrest rotation. Such an arrangement not only creates such an advantageous rotation opposing moment but also helps spread out the contact force between the backrest and base over a greater surface area reducing hinge or pivot joint wear.

Objects, features and advantages of the present invention include providing a seat equipped with a backrest constructed and arranged to accommodate a replaceable backrest panel, providing a seat having a foldable backrest that can easily be assembled to and disassembled from a seat base, providing a folding seat that has pivot joints of integral and economical construction; providing a folding seat that is of modular construction such that one component can be replaced without having to replace the entire seat; providing a folding seat having recessed pivot joints that prevent a seat occupant or person nearby from coming into contact with either pivot joint; providing a folding seat having hidden pivot joints that make the seat more aesthetically attractive; and providing a folding seat that is of simple construction, which is economical to make, which is easier and faster to assemble, which is easier to service, which is more versatile and adaptable, and which is durable, robust and reliable.

Numerous other aspects, features and advantages of the present invention will be made apparent from the following detailed description taken together with the drawing figures.

BRIEF DESCRIPTION OF THE DRAWINGS

The drawings illustrate the best mode currently contemplated of practicing the present invention. One or more preferred exemplary embodiments of the invention are illustrated in the accompanying drawings in which like reference numerals represent like parts throughout and in which.

Figure 1:
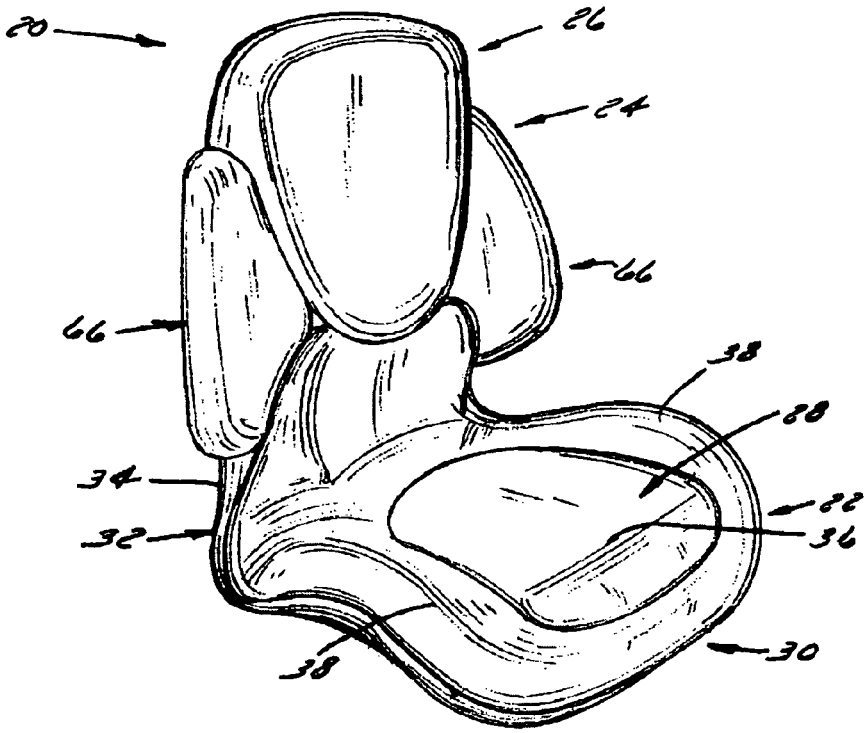
FIG. 1 is a perspective view of a seat constructed according to the present invention.

Before explaining one or more embodiments of the invention in detail, it is to be understood that the invention is not limited in its application to the details of construction and the arrangement of the components set forth in the following description or illustrated in the drawings. The invention is capable of other embodiments, which can be practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT

With reference now to the drawing figures in which like reference numerals designate like parts throughout the disclosure, a folding chair or seat is indicated generally by reference numeral 20 in FIG. 1. The seat 20 includes a base 22, a backrest 24 attached to the base 22, and a backrest center panel assembly 26 carried by the backrest 24. The base 22 can be attached to the floor or chassis of a vehicle (not shown), such as a boat, in any conventional manner to enable an individual to sit on the seat 20 while the vehicle is in operation.

Referring now to FIGS. 1-5, the base 22 includes a shell formed of any suitable rigid material, such as plastic, that enables at least that part of the base 22 to be formed in a conventional blow, injection or rotational molding process. The base 22 includes a seat occupant support portion 28 that extends in a generally horizontal direction and has a front end 30 and rear end 32, and a backrest support portion 34 that extends generally vertically from the rear end 32 of the seat portion 28. The backrest support portion 34 is upturned so as to lie, for example, behind the lower back or sacral region of a seat occupant (not shown) sitting in the seat 20. The seat portion 28 and backrest support portion 34 can be integrally formed with one another from a rigid material, such as a plastic, that is formed into the desired shape for the base 22 using any suitable process, such as injection molding. In the preferred embodiment shown in FIG. 1, the seat portion 28 and backrest support portion 34 are of one-piece, unitary and homogenous construction and are preferably molded as a single piece.

Further, the base 22 preferably also includes a seat cushion 36 attached to it that preferably is of resilient construction. The cushion 36 preferably is shaped correspondingly to and positioned over the base 22 in alignment with the seat portion 28 and support portion 34. The cushion 36 preferably includes a pair of downwardly sloping side bolsters 38 which curve downwardly from the front end 30 to the rear end 32 of the seat portion 28. The downwardly sloping curve of the side bolsters 38 enables water or other liquids splashing or flowing onto the cushion 36 to be directed off of and away from the cushion 36 to provide a generally self-wiping seating surface on the base 22. The cushion 36 can be formed of any suitable material, such as a closed-cell foam material or an open-cell foam material. The cushion 36 can be secured to the base 22 in any conventional manner, such as by an adhesive, one or more fasteners, sonic welding or any other suitable and well-known technique to retain the cushion 36 on the base 22.

Figure 5:
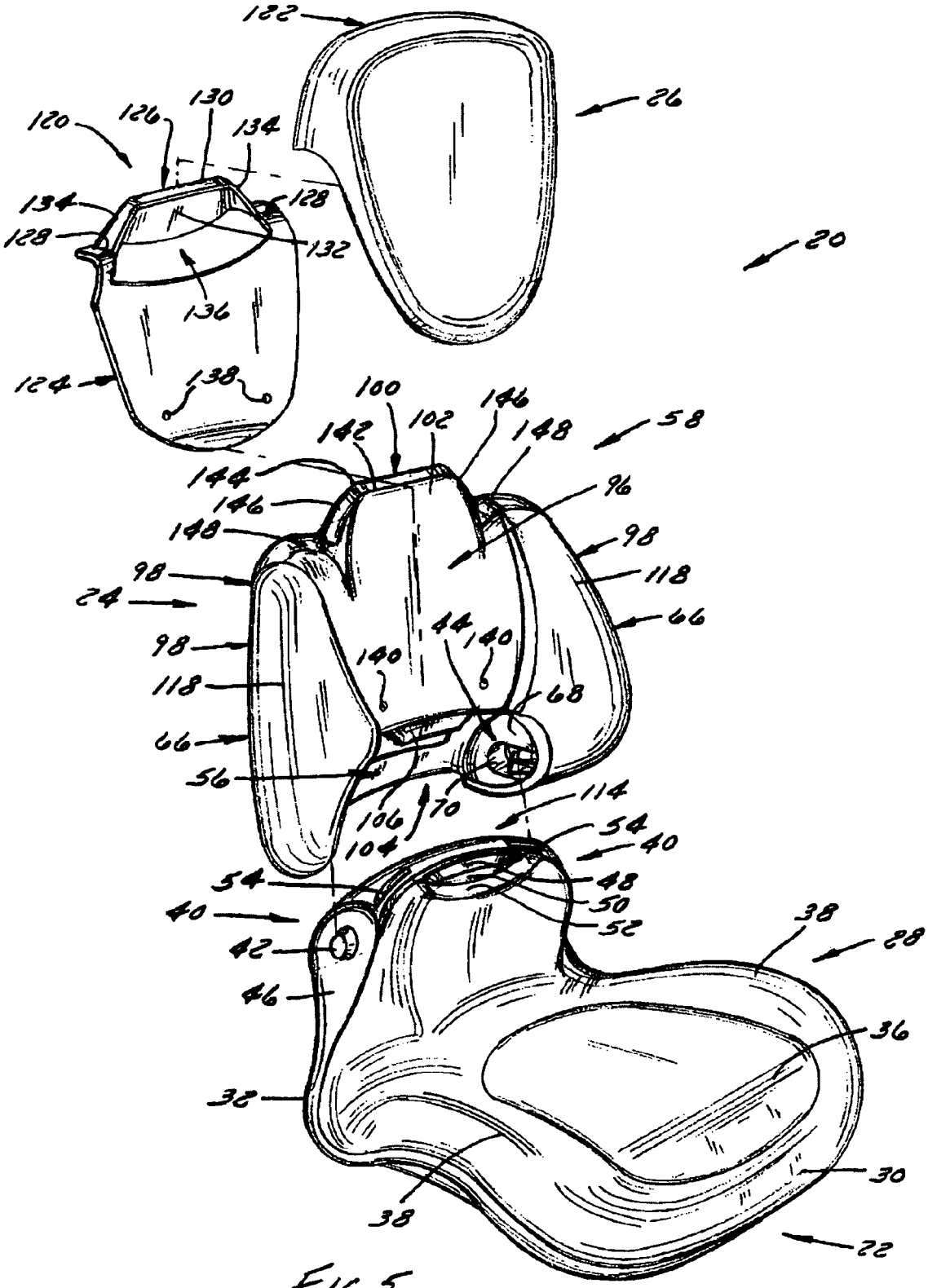
FIG. 5 is an exploded perspective view of the seat of FIG. 1.
Figure 6:
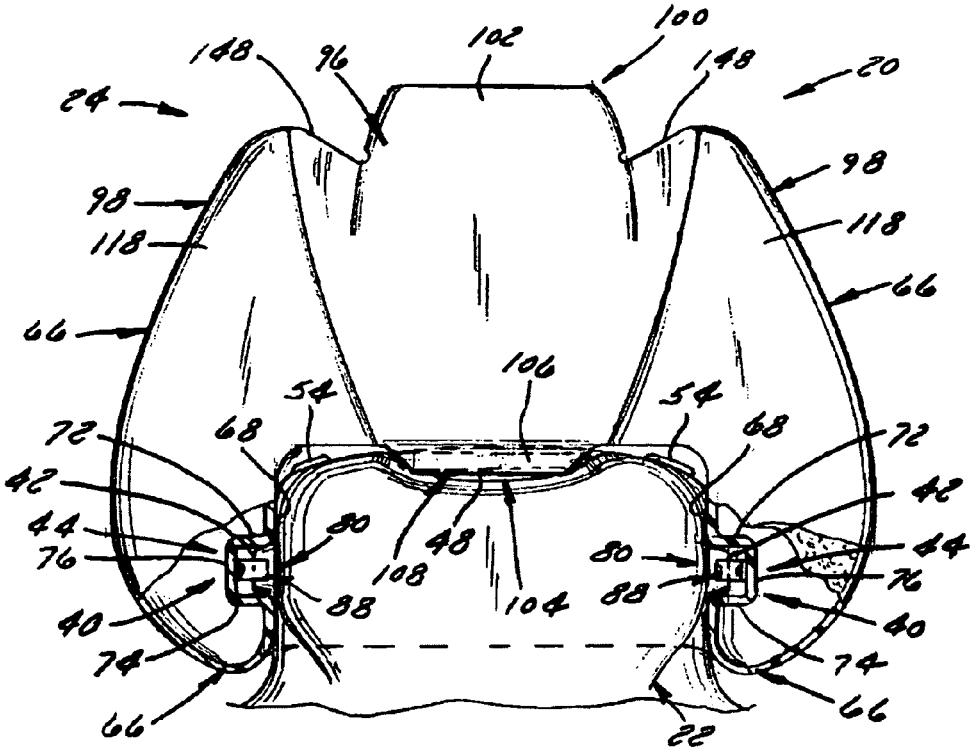
FIG. 6 is a partially broken away front plan view of the attachment of a backrest of the seat of FIG. 1 to a base of the seat of FIG. 1.
Figure 7:
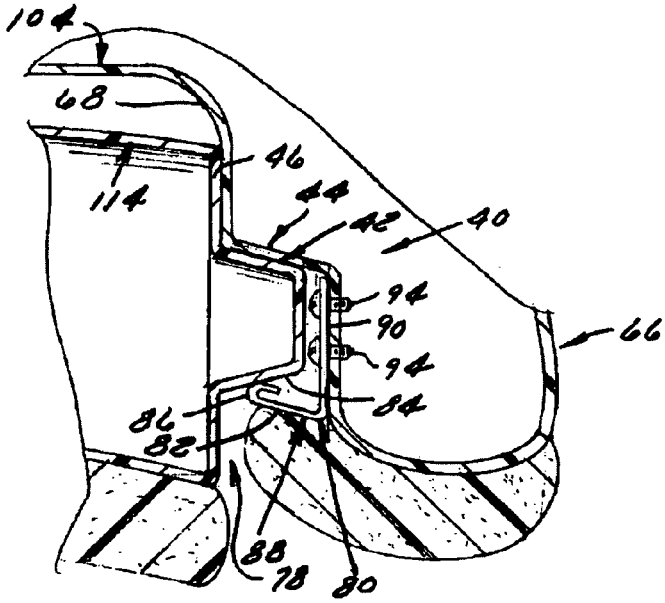
FIG. 7 is a partially broken away cross-sectional view of the securing arrangement of the seat of FIG. 6.

Referring additionally to FIGS. 5-7, the backrest 24 is hingably attached to the seat base 22 by a pair of laterally spaced apart pivots 40. In the preferred embodiment shown in FIGS. 5-7, each pivot 40 is formed by a boss 42 that is rotatively received in a pocket 44 in the seat base 22.

Each boss 42 extends outwardly from a sidewall 46 of the support portion 34. Each boss 42 is generally circular in shape, but may have other suitable shapes, depending on the particular path desired for the pivoting movement of the backrest 24. The support portion 34 also includes a detent notch 48 extending across an end wall 50 of the support portion 34 that is preferably spaced between and equidistant from each of the bosses 42. The seat cushion 36 is formed with a clearance recess 52 (FIG. 5) adjacent the notch 48 that prevents the cushion 36 from obscuring any part of the notch 48 when the cushion 36 is secured to the base 22. The support portion end wall 50 also includes a plurality of outwardly projecting ribs 54, each of which is located between an end of the detent notch 48 and an adjacent one of the bosses 42.

Figure 2:
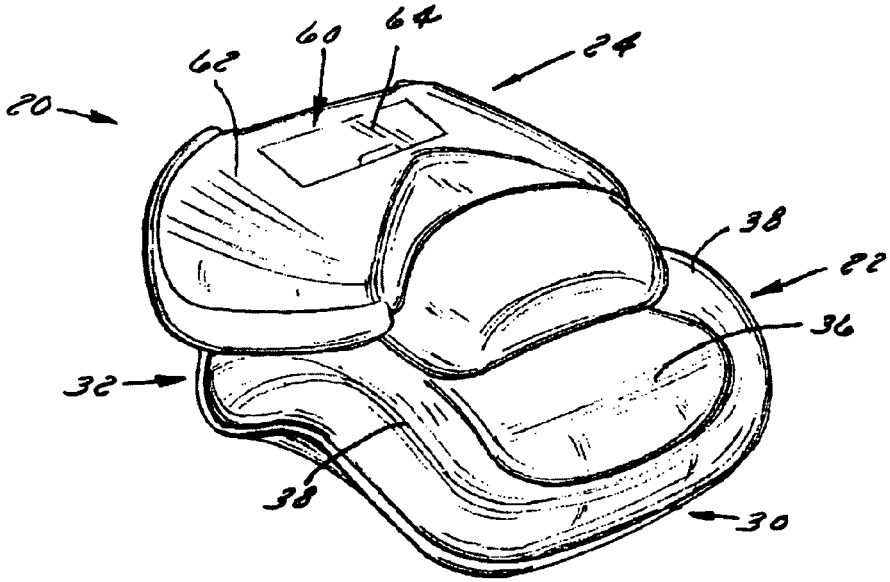
FIG. 2 is a perspective view of the seat of FIG. 1 in a folded or storage position.

As the backrest 24 is rotated towards the base 22 into a folded down position, such as the folded down position shown in FIG. 2, each one of the ribs 54 engages a rib 55 of a corresponding plurality of ribs 55 (FIG. 12) integrally formed in a bottom end wall 56 of the backrest 24 and form a detent arrangement that opposes the backrest 24 from inadvertently rotating upwardly toward the vertical position, such as, for example, during transport. The ribs 54 and corresponding ribs 55 on the lower end 56 of the backrest 24 are constructed and arranged to provide up to 0.2 inches of interference between them, thereby providing an appropriate amount of resistance to prevent such inadvertent movement when the backrest 24 is in its fully folded position. This interfering rib arrangement does so while still allowing the backrest 24 to be easily manually flipped up from its folded position to an upright position, such as the fully upright position shown in FIG. 1.

Figure 12:
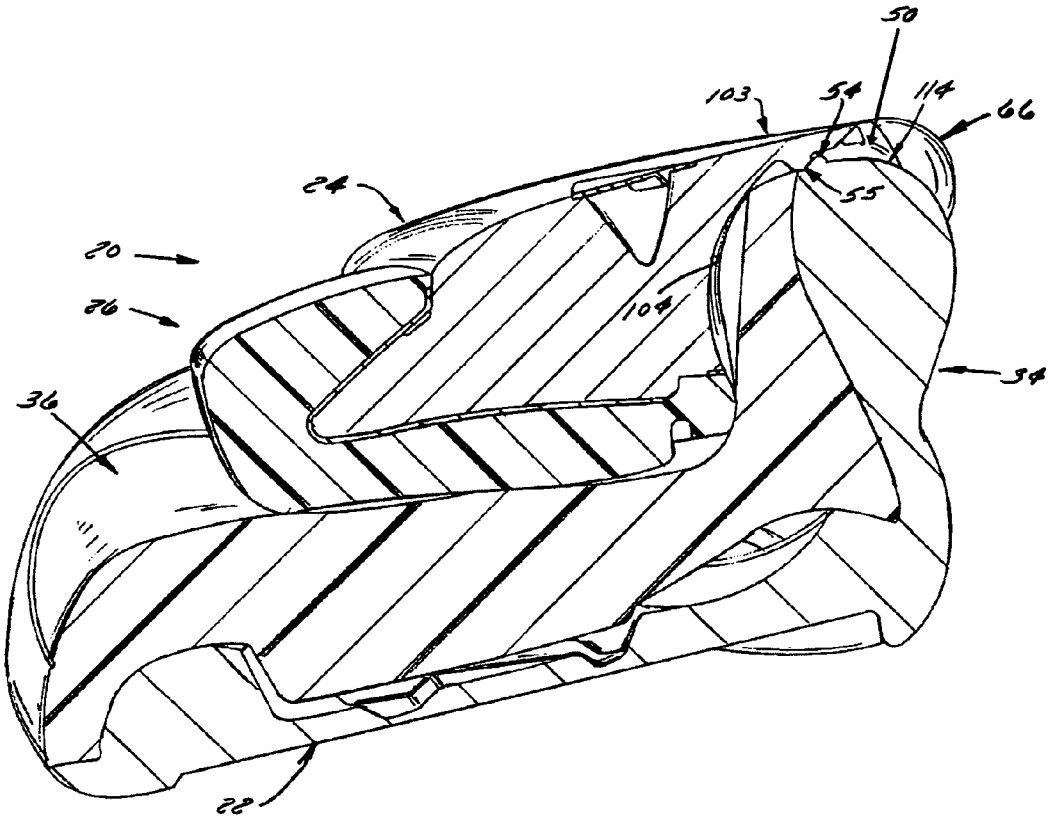
FIG. 12 is a perspective cross sectional view of a preferred embodiment of the folding seat made in accordance with the invention depicting the backrest parked in a folded position.

In the preferred folding seat embodiment shown in FIG. 12, each backrest parking rib 55 is located on an aft overhang 103 of the backrest bottom wall 104. Preferably, one rib 55 is located adjacent one of the backrest arms 66 and the other rib 55 is located adjacent the other one of the backrest arms 66 with the ribs 55 being spaced apart but transversely aligned. In another preferred embodiment, parking of the backrest 24 in a folded position can be accomplished using a single rib 55 that extends transversely. While there preferably is a pair of transversely extending and spaced apart folded backrest parking ribs 54 shown in FIG. 5, if desired, a single parking rib 54 can also be used.

The backrest 24 also includes a shell formed of a rigid, preferably plastic material that is capable of being formed in a conventional blow or injection molding process, similar to that of the base 22. The backrest 24 is generally rectangular in shape, with a wider lower end 56 and a narrower upper end 58. The interior of the backrest 24 preferably is generally hollow in order to reduce the overall weight and material cost for the backrest 24, as well as to provide the capability for formation of an optional storage pocket 60 (FIG. 2) in a rear surface 62 of the backrest 24. The pocket 60 preferably includes a hinged cover 64 that can be moved with respect to the rear surface 62 of the backrest 24 to expose the interior of the pocket 60 and any items placed therein, such as an operating manual for the vehicle. The pocket 60 can be formed integrally with the backrest 24 during the molding process, or can formed as a cut out of the material forming the rear surface 62 of the backrest 24 after molding the backrest 24.

The lower end 56 of the backrest 24 includes a pair of downwardly extending lobes or arms 66 that are spaced apart to receive part of the support portion 34 of the seat base 22 therebetween. Each arm 66 has an inner sidewall 68 disposed adjacent and toward an outer sidewall 46 of the support portion 34. One of the boss retainer pockets 44 is integrally formed in one of the sidewalls 68 and the other one of the boss retainer pockets 44 is integrally formed in the other one of sidewalls 68. Each pocket 44 is dimensioned to releasably receive and help rotatably retain one of the bosses 42 of the support portion 34. Each pocket 44 preferably has a shape that is complementary to the boss 42 it receives.

Each pocket 44 preferably is a channel that is defined by a rounded end wall 70 (FIG. 5) a pair of guide walls 72 and 74, a sidewall 76, and a mouth 78 (FIG. 7). The shape of each pocket 44 and boss 42 corresponds generally to one another in order to enable the backrest 24 to rotate about both bosses 42 thereby enabling the backrest 24 to be folded and unfolded. More specifically, each pocket 44 has a diameter or width that is at least slightly greater than the diameter or width of the boss 42 it receives to enable each boss 42 to rotate freely within its corresponding pocket 44.

In order to help keep each boss 42 seated within its respective pocket 44, each pocket 44 preferably is configured with a retainer 80 that is constructed and arranged to permit insertion of the boss 42 into the pocket 44 through its mouth 78 and thereafter oppose its withdrawal. The retainer 80 includes a finger 82 that extends outwardly into the mouth 78 of the pocket 44. During assembly, the boss 42 bears against the finger 82, causing it to flex inwardly toward the pocket 44 until the end of the boss 42 clears the end of the finger 82 and snaps into the pocket 44. Thus, a snap fit preferably is provided between the retainer 80 and the boss 42 during assembly.

Once the boss 42 is received in the pocket 44, the finger 82 relaxes and straightens out, creating interference between it and the free end of the boss 42 thereby opposing withdrawal of the boss 42 from the pocket 44. A sliding fit preferably is provided between the finger 82 and an outer sidewall 84 the boss 42 so that the boss 42 remains seated in the pocket 44 while being able to freely rotate when the backrest 24 is flipped up or down. To help facilitate assembly of the boss 42 into its associated pocket 44 and provide a bearing surface against which part of the boss 42 can ride during rotation, the finger 82 preferably has a smooth or curled end 86.

Figure 8:
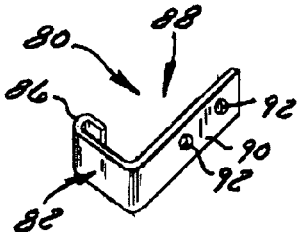
FIG. 8 is an isometric view of a securing member used in the securing arrangement of FIG. 7.

In the preferred retainer embodiment shown in FIGS. 7 and 8, the retainer 80 is a component separate from the backrest 24. In the preferred retainer embodiment shown in FIGS. 7 and 8, the retainer 80 is a bracket 88 that has an anchor plate 90 disposed in the pocket 44 with its finger 82 disposed in the mouth 78 of the pocket 44. The plate 90 has a pair of through bores 92 (FIG. 8) that each receives a fastener 94 (FIG. 7) used to attach the retainer bracket 88 to the sidewall 76 of the pocket 44. Each fastener 94 preferably is a screw or bolt.

As is also shown in FIG. 5, the backrest 24 preferably includes a centrally located backrest center panel mounting surface 96 that is disposed along its front side between a pair of generally vertically extending side bolsters 98. The top end 100 of the mounting surface 96 tapers or necks down so as to form a head 102 constructed and arranged to releasably accept the backrest center panel assembly 26 thereon.

The backrest 24 has an integral bottom wall 104 (FIG. 7) that is located between its downwardly extending arms 66. The bottom wall 104 includes an outwardly projecting pawl 106 that is releasably received in the notch 48 in the top surface 50 of the support portion 34 of the seat base 22 when the backrest 24 is rotated to its fully upright position. Together the pawl 106 and the notch 48 form a releasable latch arrangement 108. When the pawl 106 is seated in the notch 48, the latch arrangement 108 helps keep the backrest 24 in its fully upright position. It does so by opposing rotation of the backrest 24 away from its fully upright position.

Figure 9:
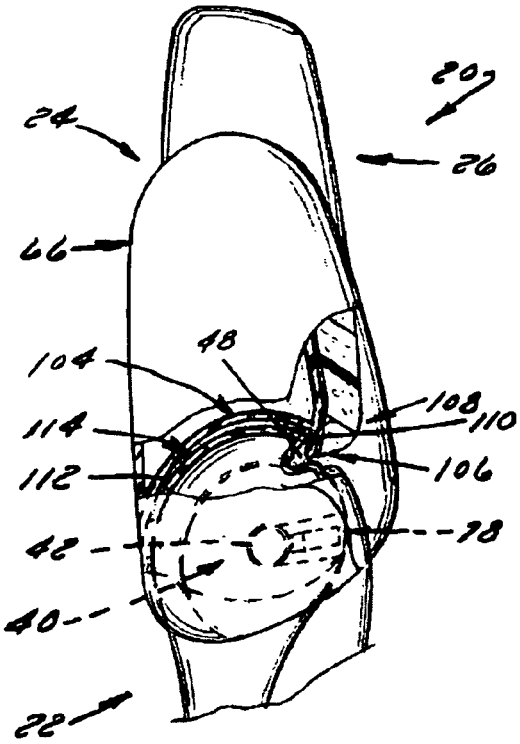
FIG. 9 is a partially broken away left side plan view of the seat of FIG. 1 in a use position.
Figure 10:
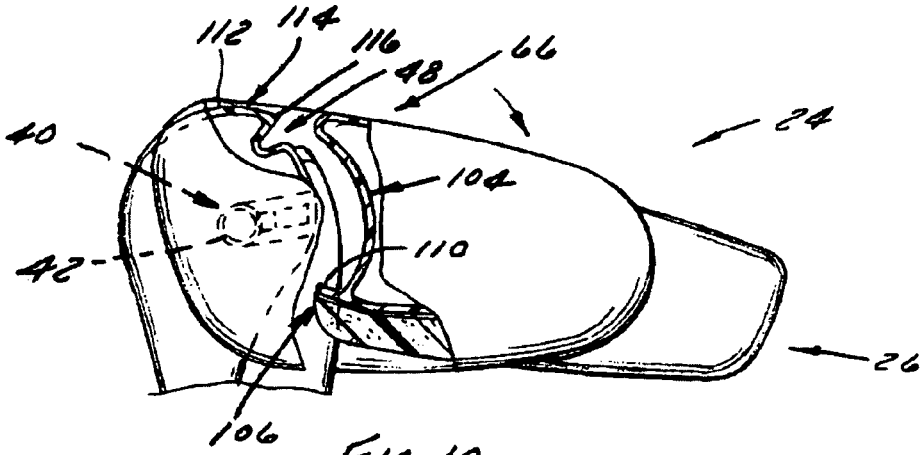
FIG. 10 is a partially broken away left side plan view of the seat of FIG. 2 in a storage or parked position.

As is shown in more detail in FIGS. 9 and 10, the pawl 106 is a lip or flange 110 that preferably is integrally formed as part of the backrest 24. The flange 110 extends downwardly from adjacent a front edge of the bottom wall 104 of the backrest 24 and extends laterally substantially the length of the notch 48. Referring to FIG. 9, when the backrest 24 is disposed in its fully upright position, the flange 110 is received in the notch 48. Rotation of the backrest 24 farther backward beyond the fully upright position is opposed by the flange 110 abutting against a frontward facing rear edge of the notch 48. When the backrest 24 is disposed in its fully upright position, inadvertent forward rotation of the backrest 24 is prevented by the flange 110 bearing against a front edge of the notch 48. To fold the backrest 24, the backrest 24 is manually urged forwardly causing the flange 110 to cam along the front edge of the notch 48 until it clears the notch 48. Once the flange 110 clears the front edge of the notch 48, the backrest 24 can then be easily rotated forwardly toward its folded position.

As the backrest 24 is rotated toward its fully upright position, a portion of the bottom wall 104 of the backrest 24 cams against an aft portion 112 of the top surface 114 of the support portion 34 of the seat base 22 creating interference therebetween that opposes backrest rotation beyond the fully upright position. Together, the engagement between the pawl 106 and notch 48 when latched and the interference that occurs between the backrest bottom wall 104 and the aft portion 112 of the top surface 114 of the support portion 34 of the seat base 22 cooperate to form a force couple that resists rearward backrest loads from creating counterclockwise moments and substantially reduces the resultant force on the pivots 40, thereby increasing the longevity of the pivot joint formed at each pivot 40.

In addition, depending on, for example, the magnitude of the force applied against the backrest 24, each boss 42 can displace in its pocket or channel 44 until it bears against a stop thereof, preferably part of the retainer 80, such as the finger 82. This additional moment, along with the rest of these moments, collectively form a moment, e.g., force couple, that help prevent backrest over rotation. These three regions of engagement or contact also help spread out force applied urging the backrest rearwardly beyond its upright stop position, e.g. its fully upright position, over a greater contact surface area and along surfaces and angles facilitating force transfer, thereby advantageously reducing joint wear and tear enabling pivot joints of substantially plastic construction to be used.

If desired, contact between one or both bosses 42 with its corresponding retainer finger 82 can occur before engagement between the backrest bottom wall 104 and the aft portion 112 of the top surface 114 of the support portion 34 of the seat base 22. The order of these aforementioned backrest limiting engagements can also occur in a sequence different than that discussed above.

Additionally, when the backrest bottom wall 104 is in contact with the aft portion 112 of the top surface 114 of the support portion 34 of the seat base 22 the wedging action between these two surfaces preferably prevents the pawl 106 from camming over the rear edge 116 (FIG. 10) of the notch 48 in response to rearwardly directed loads applied to the backrest 24. For example, when the backrest 24 is urged forwardly with sufficient force, the pawl 106 unseats from the notch 48 unlatching the latch arrangement 108 and permitting the backrest 24 to be folded downwardly toward the seat base 22.

The backrest bolsters 98 preferably each include a resilient cushion 118 fixed thereto to provide a generally continuous cushioned surface on the seat 20 in conjunction with the cushion 36 secured to the seat base 22. Each cushion 118 extends along its associated bolster 98 and along the connected arm 66 of the backrest 24. The backrest center panel mounting surface 96 is disposed between the cushions 118. In assembly, the backrest center panel assembly 26 is cradled on the head 102 of the top end 100 of the mounting surface 96 of the backrest 24. When assembled to the backrest 24, the backrest center panel assembly 26 helps provide a contoured, aesthetically pleasing, and centrally located cushioned surface that provides support to the upper back of a seat occupant (not shown).

Figure 11:
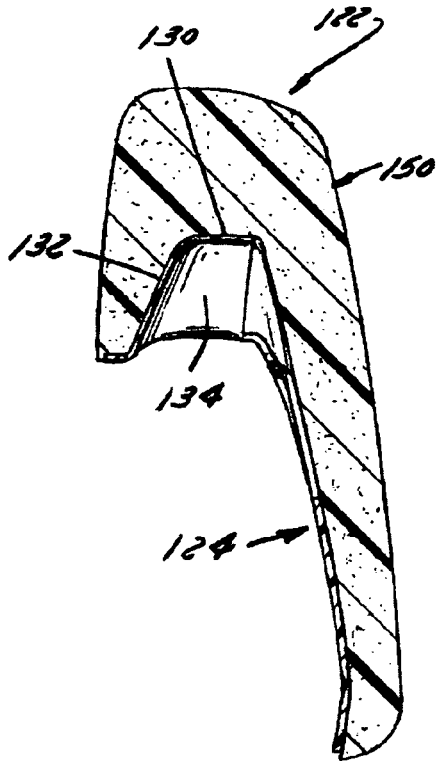
FIG. 11 is a cross-sectional view of the backrest panel of the seat of FIG. 1.

Referring now particularly to FIGS. 5 and 11, the backrest center panel assembly 26 includes an inner saddle 120 upon which an outer cushioned mantle 122 rests. The saddle 120 preferably is formed of one-piece, unitary and homogeneous construction. The saddle 120 has a front anchor panel 124 that is attached to a crown 126 by a pair of spaced apart curved arms or buttresses 128. The crown 126 is formed by a top wall 130, rear wall 132 and a pair of sidewalls 134 that define a hood or socket 136 in which the head 102 of the backrest center panel mounting surface 96 is received when the saddle 120 is assembled to the backrest 24.

When the saddle 120 is received on the backrest center panel mounting surface 96, a fastener (not shown) preferably is used to attach the front anchor panel 124 to the backrest 24 at locations bearing reference numeral 138 for the anchor panel 124 and bearing reference numeral 140 for the backrest 24. If desired, each fastener can be integrally formed as part of the anchor panel 124 and/or part of the backrest 24 or the backrest center panel mounting surface 96. If desired, sonic welding, an adhesive, or another type of fastener, such as a hook and loop fastener, can be used to help attach the saddle 120 to the backrest 24 in a manner that can be releasable.

When the saddle 120 is assembled onto the backrest 24, the head 102 at the top end of the backrest center panel mounting surface 96 is received in the socket 136 defined by the walls 130, 132, and 134 of the crown 126. Each of these walls 130, 132, and 134 abuts against a corresponding wall 142 (top), 144 (rear), and 146 (sides) so as to positively retain the saddle 120 on the head 102 of the backrest 24 while permitting a slight amount of play therebetween. When assembled, each buttress 128 hooks or rests upon a shoulder 148 of the backrest 24, each of which lies to one side of the head 102.

The cushioned mantle 122 is received on the saddle 120. The saddle 120 preferably is molded of plastic and is sufficiently stiff to provide support to a resilient cushion 150 of the mantle 122. The cushion 150 preferably is made of foam, such as open or closed cell foam. The mantle 122 preferably is mounted on the saddle 120 in a manner that opposes its separation from the saddle 120. For example, the cushion 150 of the mantle 122 can be constructed and arranged to tightly fit over the saddle 120 such that it is frictionally retained on the saddle 120. If desired, an adhesive or a fastener, such as a hook and loop fastener (not shown) can be used to help fix the cushion 150 to the saddle 120.

Figure 3:
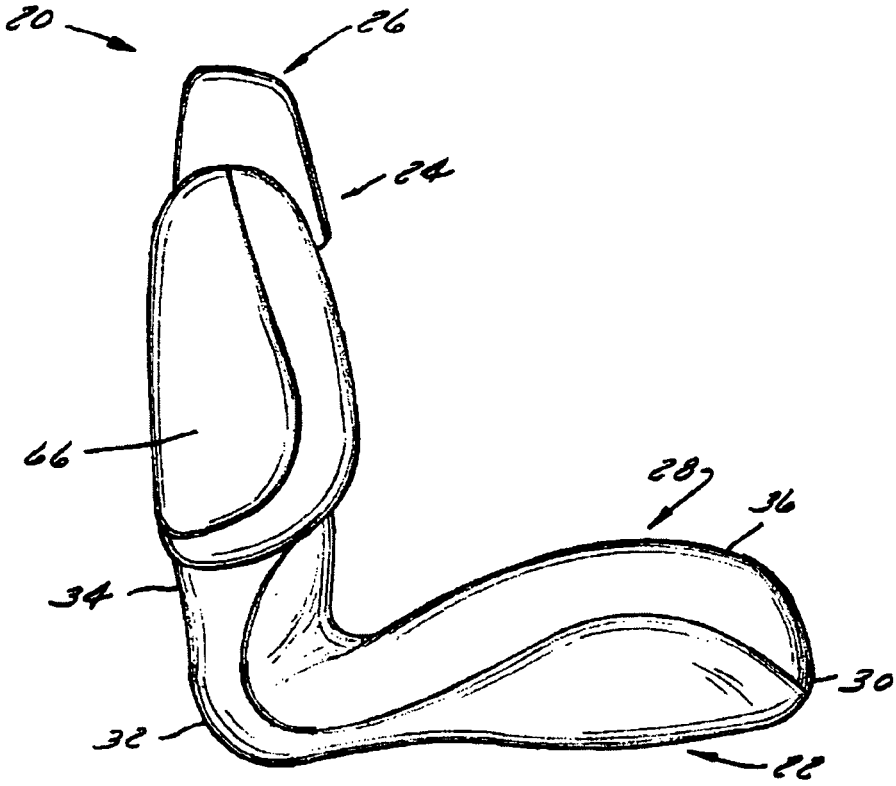
FIG. 3 is a left side plan view of the seat of FIG. 1.
Figure 4:
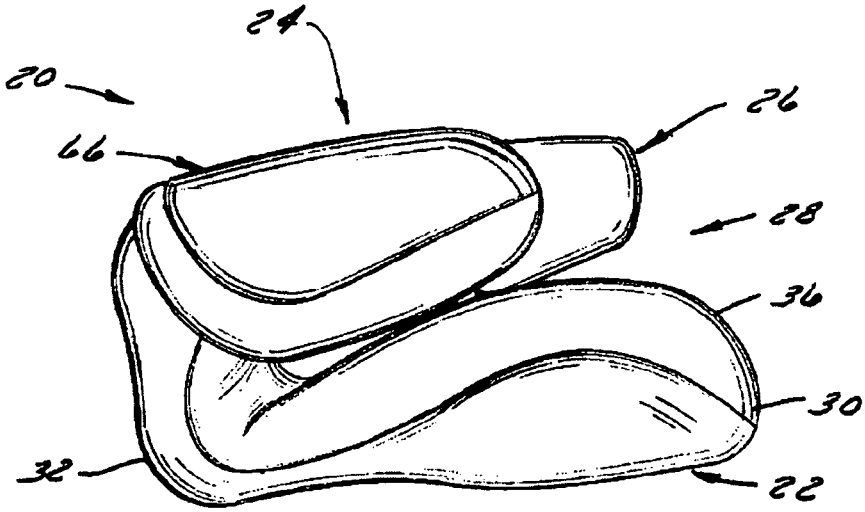
FIG. 4 is a left side plan view of the seat of FIG. 2.

Due to the fact that each of the components of the seat 20 are releasably secured to one another, not only does the connection between the base 22 and backrest 24 enable the seat 20 to be moved between a storage or non-use position, like that shown in FIGS. 2, 4 and 10, and an open or use position, like that shown in FIGS. 1, 3 and 9, the connection between the components of the seat 20 enables one or more of them to be disconnected from one another for various reasons. More specifically, the backrest center panel assembly 26 can be removed from the backrest 24 to enable a backrest center panel assembly 26 having a worn or damaged cushion 150 to be replaced or repaired. In a like manner, the backrest 24 can be disassembled from the seat base 22 by manually deflecting the finger 82 of each pivot 40 inwardly toward the adjacent boss 42 enough to permit the boss 42 to at least partially clear the end of the finger 82.

Further, since each of these seat components 22, 24 and 26 is formed separately, it means that the cushions of each component are separately upholstered thereby enabling a desired aesthetic appearance to be achieved. Because each of these components 22, 24 and 26 can be disassembled and replaced, only the component requiring replacement need be replaced thereby obviating replacement of the entire seat as was commonly required in the prior art.

Although each boss 42 is shown disposed on each sidewall 46 of the support portion 34 of the base 22 that serves as a backrest mount, a boss 42 could instead be disposed on the inner sidewall 68 of each backrest arm 66. Likewise, where the bosses 42 are so disposed, a boss-receiving pocket 44 can be disposed in each sidewall 46 of the support portion 34 of the base 22.

The arms 66 are preferably disposed on the backrest 24. However, if desired, they can be formed as part of the base 22 with the mount or support portion 34 then being formed as part of the backrest 24.

It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

It is claimed:

1. A foldable seat comprising:

a base that underlies a seat occupant supporting surface;

a backrest;

a snap-fit pivot arrangement attaching the backrest to the base such that the backrest is pivotable between a generally upright position and a folded position disposed from the generally upright position;

a detent arrangement formed of the base and the backrest that is disposed within the seat when the backrest is located in the generally upright position with the detent arrangement including a first interference stop that prevents pivotable movement of the backrest when in the generally upright position away from the generally upright position and away from the folded position and a second interference stop adjacent the first interference stop that releasably retains the backrest in the generally upright position by opposing pivotable movement of the backrest toward the folded position when in the generally upright position but permitting pivotable movement of the backrest toward the folded position with application of manual force; and wherein the snap-fit pivot arrangement is comprised of a ball formed of one of the backrest and the base that is pivotably received in a socket formed in the other one of the backrest and the base defining a plurality of interiorly hidden pivot joints therebetween.

2. The foldable seat of claim 1 wherein each pivot joint comprises a pivot pin integrally formed in one of the ball and the socket, a pivot pin receiver integrally formed in the other one of the ball and the socket, and a releasable pivot pin retainer disposed in the pivot pin receiver.

3. The foldable seat of claim 2 wherein the ball is integrally formed from a lumbar-supporting portion of the base that extends upwardly rearwardly of a seat occupant and the backrest comprises a pair of generally parallel and integrally formed downwardly extending arms defining the socket therebetween and wherein one of the pivot pins extends outwardly from one side of the ball into one of the pivot pin receivers formed in one of the backrest arms and the other one of the pivot pins extends outwardly from an opposite side of the ball into the other one of the pivot pin receiver formed in the other one of the backrest arms.

4. The foldable seat of claim 1 wherein the detent arrangement comprises a detent notch formed in an end wall of one of the base and the backrest and a rib formed in an end wall of the other one of the base and the backrest that is releasably received in the detent notch when the backrest is disposed in the generally upright position.

5. The foldable seat of claim 4 wherein the detent notch is defined by a pocket having a rear edge that serves as the first interference stop that opposes pivoting of the backrest away from the folded position rearwardly beyond the generally upright position and a front edge spaced from the rear edge that serves as the second interference stop that opposes pivoting of the backrest toward the folded position releasably retaining the backrest in the generally upright position when the rib is received in the detent notch.

6. The foldable seat of claim 1 further comprising a backrest rotation limiter formed by a region of camming or wedging engagement between the base and the backrest that prevents pivotable movement of the backrest.

7. The foldable seat of claim 1 wherein both the base and the backrest have opposed curved end walls that cam or wedge against one another when the backrest is urged rearwardly away from the generally upright position opposing rearward backrest rotation beyond the generally upright position.

8. A foldable seat comprising:

a base that underlies a seat occupant supporting surface;

a backrest;

a snap-fit pivot arrangement attaching the backrest to the base such that the backrest is pivotable between a generally upright position and a folded position disposed from the generally upright position;

a detent arrangement formed of the base and the backrest that is disposed within the seat when the backrest is located in the generally upright position with the detent arrangement comprised of a pair of spaced apart stops of one of the base and backrest that cooperates with the other one of the base and backrest releasably retaining the backrest in the generally upright position while permitting the backrest to be moved toward the folded position upon application of manual force; and wherein the snap-fit pivot arrangement comprises a ball that is integrally formed of part of one of the base and the backrest and a socket that is integrally formed in part of the other one of the base and the backrest that receives the ball.

9. The foldable seat of claim 8 further comprising a backrest parking detent arrangement integrally formed between the base and backrest that releasably retains the backrest in the folded position opposing rearward pivoting of the backrest toward the generally upright position.

10. The foldable seat of claim 9 further comprising a backrest rotation limiting arrangement comprised of camming or wedging engagement between the base and the backrest that limits rearward pivoting of the backrest when the backrest is disposed in the generally upright position.

11. The foldable seat of claim 8 wherein the snap-fit pivot arrangement defined by the ball and socket is of concealed or hidden construction.

12. A foldable seat comprising:

a base that underlies a seat occupant supporting surface;

a backrest;

a snap-fit pivot arrangement attaching the backrest to the base such that the backrest is pivotable between a generally upright position and a folded position disposed from the generally upright position;

a detent arrangement formed of the base and the backrest that is disposed within the seat when the backrest is located in the generally upright position with the detent arrangement comprised of a pair of spaced apart stops of one of the base and backrest that cooperates with the other one of the base and backrest releasably retaining the backrest in the generally upright position while permitting the backrest to be moved toward the folded position upon application of manual force; and wherein one of the base and the backrest comprises a pair of generally spaced apart arms that engage the other one of the base and the backrest with the snap-fit pivot arrangement comprising a pair of snap-fit pivot joints having one of the snap-fit pivot joints formed where one of the arms engage the other one of the base and the backrest and the other one of the snap-fit pivot joints formed where the other one of the arms engage the other one of the base and the backrest.

13. The foldable seat of claim 12 wherein the one of the base and the backrest comprises a first wall disposed between the pair of arms and the other one of the base and the backrest comprises a second wall that opposes the first wall and wherein the detent arrangement is formed by engagement between the first and second walls and interiorly disposed therebetween so as to be hidden when the backrest is disposed in the generally upright position.

14. The foldable seat of claim 13 wherein the first and second walls are complementarily curved and spaced such that rotation of the backrest rearwardly away from the generally upright position away from the folded position causes engagement between the first and second walls to oppose further rearward backrest rotation beyond the generally upright position.

15. The foldable seat of claim 13 further comprising a backrest parking detent arrangement comprised of an upraised first rib of the first wall that engages an upraised rib of the second wall when the backrest is disposed in the folded position releasably retaining the backrest in the folded position.

16. A foldable seat comprising:

a base that underlies a seat occupant supporting surface;

a backrest;

a snap-fit pivot arrangement attaching the backrest to the base such that the backrest is pivotable between a generally upright position and a folded position disposed from the generally upright position;

a detent arrangement formed of the base and the backrest that is disposed within the seat when the backrest is located in the generally upright position with the detent arrangement comprised of a pair of spaced apart stops of one of the base and backrest that cooperates with the other one of the base and backrest releasably retaining the backrest in the generally upright position while permitting the backrest to be moved toward the folded position upon application of manual force; and wherein the snap-fit pivot arrangement comprises a pivot that is releasably captured in a pivot receptacle by a retainer disposed in the pivot receptacle.

17. The foldable seat of claim 16 wherein the pivot and pivot receptacle are not exteriorly visible when the pivot is received in the pivot receptacle and wherein the retainer comprises a flexible upraised finger.

18. The foldable seat of claim 16 wherein the pivot comprises a generally cylindrical boss that is cantilevered and integrally formed of one of the backrest and the base and the pivot receptacle comprises a recess integrally formed in the other one of the backrest and the base that has a mouth through which the boss is inserted during assembly that is spaced from a recess end wall with the retainer being disposed in the recess adjacent the mouth and spaced from the recess end wall.

19. A foldable seat comprising:

a base that provides a seat occupant supporting surface;

a backrest;

a snap-fit pivot arrangement attaching the backrest to the base such that the backrest is pivotable between a generally upright position and a folded position with the snap-fit pivot arrangement comprising a pivot that is releasably retained in a pivot receptacle by a retainer wherein the pivot is cantilevered and integrally formed of one of the backrest and the base;

wherein the pivot receptacle comprises a recess integrally formed in the other one of the backrest and the base; and wherein the retainer is flexible, extends outwardly from the other one of the backrest and the base, and is located such that it opposes movement of the pivot relative to the pivot receptacle toward the retainer and in a direction generally transverse to an axis about which the pivot is rotatable.

20. The foldable seat of claim 19 wherein the pivot receptacle has a mouth through which the pivot enters during assembly and the retainer is disposed adjacent and in line therewith.

21. The foldable seat of claim 20 wherein the retainer comprises a finger that is attached to the other one of the backrest and the base.

22. The foldable seat of claim 19 wherein the base and backrest are molded of plastic with the pivot comprising a boss integrally molded as part of the base and the backrest and the pivot receptacle comprising an oblong channel integrally molded into the other one of the backrest and the base.

23. A foldable seat comprising:

a seat base;

a backrest;

an interiorly disposed pivot arrangement that permits the backrest to pivot relative to the base;

wherein one of the base and the backrest comprises a pair of spaced apart arms and receive a part of the other one of the base and the backrest therebetween;

wherein the pivot arrangement comprises a pair of spaced apart pivot joints with one pivot joint disposed between one of the arms and an adjacent part of the other one of the base and backrest received between the arms and the other pivot joint disposed between the other one of the arms and an adjacent part of the other one of the base and backrest received between the arms;

wherein each arm has an inboard sidewall and the part of the other one of the base and the backrest received between the arms has a pair of outboard sidewalls, and wherein each pivot joint is comprised of a boss that cantilevers outwardly from a respective one of the inboard and outboard sidewalls and is received in a receiver formed in the respective other one of the inboard and outboard sidewalls; and wherein each receiver comprises a pocket that has a mouth through which a respective boss is inserted during assembly and a retainer disposed adjacent the mouth of the pocket that releasably retains the boss in the pocket when inserted therein.

24. A foldable seat comprising:

a seat base;

a backrest;

a pivot arrangement formed where the backrest engages the base permitting the backrest to pivot relative to the base with the pivot arrangement comprising a plurality of pivot joints each of which comprises a pivot pin that extends outwardly from one of the seat base and backrest and a pivot pin receiver formed in the other one of the seat base and backrest; and wherein each pivot pin receiver comprises a pocket that has a mouth through which a respective pivot pin is inserted during assembly and a flexible retainer disposed adjacent the mouth of the pocket that flexes to permit insertion of the pivot pin into the pocket and thereafter opposes removal of the pivot pin from the pocket.

25. The foldable seat of claim 24 wherein backrest is pivotable relative to the base between a fully upright position and a folded position where the backrest overlies the base with the backrest and base each comprising an end wall engagable with one another (a) along a first region of engagement between the end walls when the backrest is disposed in the fully upright position releasably retaining the backrest in the fully upright position and (b) along a second region of engagement between the end walls when the backrest is disposed in the folded position releasably retaining the backrest in the folded position.

26. The foldable seat of claim 25 wherein the first region of engagement between the end walls that releasably retains the backrest in the fully upright position comprises a first detent arrangement integrally formed of a plurality of inter-engaging upraised sections of the end walls and the second region of engagement between the end walls that releasably retains the backrest in the folded position comprises a second detent arrangement integrally formed of a plurality of inter-engaging upraised sections of the end walls.

27. A foldable seat comprising:

a seat base;

a backrest;

a pivot arrangement formed where the backrest engages the base permitting the backrest to pivot relative to the base with the pivot arrangement comprising a plurality of pivot joints each of which comprises a pivot pin that extends outwardly from one of the seat base and backrest and a pivot pin receiver formed in the other one of the seat base and backrest; and wherein each pivot pin receiver comprises a pocket that has a mouth through which a respective pivot pin is inserted during assembly and a flexible retainer disposed adjacent the mouth of the pocket that flexes to permit insertion of the pivot pin into the pocket and thereafter opposes removal of the pivot pin from the pocket;

wherein the backrest is pivotable relative to the base between a fully upright position and a folded position where the backrest overlies the base with the backrest and base each comprising an end wall engagable with one another (a) along a first region of engagement between the end walls when the backrest is disposed in the fully upright position releasably retaining the backrest in the fully upright position and (b) along a second region of engagement between the end walls when the backrest is disposed in the folded position releasably retaining the backrest in the folded position;

wherein the first region of engagement between the end walls that releasably retains the backrest in the fully upright position comprises a first detent arrangement integrally formed of a plurality of inter-engaging upraised sections of the end walls and the second region of engagement between the end walls that releasably retains the backrest in the folded position comprises a second detent arrangement integrally formed of a plurality of inter-engaging upraised sections of the end walls; and wherein each detent arrangement comprises a pawl that extends outwardly from one of the end walls that releasably cooperates with a detent receiver formed in the other one of the end walls to releasably retain the backrest in its corresponding fully upright or folded position and wherein each pivot pin comprises a generally cylindrical boss that has a generally circular cross section integrally formed of part of one of the base and the backrest and each pivot pin receiver pocket is integrally formed in the other one of the base and the backrest.

28. A foldable seat comprising:

a seat base that comprises a seat occupant supporting surface;

a backrest that cooperates with the seat base;

a pivot arrangement comprised of a pair of spaced apart pivot joints that enable the backrest to pivot relative to the seat base between a generally upright position and a folded position disposed away from the generally upright position;

a first detent arrangement comprised of a first region of engagement between the seat base and backrest opposing rearward backrest rotation beyond the generally upright position away from the folded position and a second region of engagement between the seat base and backrest releasably retaining the backrest in the generally upright position when the backrest is disposed in the generally upright position;

a second detent arrangement comprised of a third region of engagement between the seat base and backrest releasably retaining the backrest in the folded position when disposed in the folded position; and a backrest rotation limiter comprised of a first wall of the seat base in opposition to a second wall of the backrest and spaced relative thereto such that rotation of the backrest rearwardly beyond the generally upright position causes interfering engagement between the first and second walls opposing rearward backrest rotation.

* * * * *

UNITED STATES PATENT AND TRADEMARK OFFICE

CERTIFICATE OF CORRECTION

PATENT NO. : 7,472,959 B1
APPLICATION NO. : 11/127620
DATED : January 6, 2009
INVENTOR(S) : Clifton J. Ratza et al.

It is certified that error appears in the above-identified patent and that said Letters Patent is hereby corrected as shown below:

IN THE CLAIMS

CLAIM 27, column 17, line 29, after "formed" insert -- of part of one of the base and the backrest and each pivot in receiver pocket is integrally formed --.

Signed and Sealed this

Thirtieth Day of March, 2010

David J. Kappos

David J. Kappos
*Director of the United States Patent and Trademark Office*